US011465306B2

(12) United States Patent
Good

(10) Patent No.: US 11,465,306 B2
(45) Date of Patent: Oct. 11, 2022

(54) GROOMING DEVICE HAVING AN EJECT SENSOR

(71) Applicant: The Gillette Company LLC, Boston, MA (US)

(72) Inventor: Ian Anthony Good, Reading (GB)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 16/920,311

(22) Filed: Jul. 2, 2020

(65) Prior Publication Data

US 2022/0001560 A1 Jan. 6, 2022

(51) Int. Cl.
*B26B 21/40* (2006.01)
*B26B 21/52* (2006.01)
*B26B 21/22* (2006.01)

(52) U.S. Cl.
CPC ..... *B26B 21/4056* (2013.01); *B26B 21/4087* (2013.01); *B26B 21/521* (2013.01); *B26B 21/526* (2013.01); *B26B 21/225* (2013.01)

(58) Field of Classification Search
CPC ..... B26B 21/4056; B26B 21/4087; B26B 21/521; B26B 21/526; B26B 21/225
See application file for complete search history.

(56) References Cited

U.S. PATENT DOCUMENTS 10,131,063 B2 * 11/2018 Metcalf ..... B26B 21/521
2004/0098862 A1 * 5/2004 Orloff ..... B26B 21/521 30/41.7
2017/0087733 A1 3/2017 Metcalf et al.
2017/0097758 A1 4/2017 Bauer et al.
2017/0305023 A9 10/2017 Ball et al.
2019/0224869 A1 7/2019 Robinson et al.
2019/0224870 A1 * 7/2019 Robinson ..... B26B 21/4056
2019/0224871 A1 7/2019 Amavasai et al.
2020/0122348 A1 * 4/2020 Good ..... B26B 21/526
2020/0201266 A1 * 6/2020 Joyce ..... A46B 13/02

OTHER PUBLICATIONS

All Office Actions, U.S. Appl. No. 16/920,300.
(Continued)

*Primary Examiner* — Omar Flores Sanchez
(74) *Attorney, Agent, or Firm* — Kevin C. Johnson

(57) ABSTRACT

A grooming device. The grooming device includes a handle having proximal and distal ends, an implement connecting structure, grooming implement, displacement sensor, and power source providing power to the displacement sensor. The implement connecting structure is pivotably connected to the proximal end of the handle about a first handle axis and has a connection element and an eject element that is moveable within the implement connecting structure along a second handle axis. The implement connecting structure also has a location element pivotably connected to the eject element such that as the implement connecting structure moves about the first handle axis the location element remains stationary relative to the handle and as the eject element moves along the second handle axis the location element is displaced relative to the handle and the displacement sensor detects displacement of the location element. The grooming implement is connected to the implement connecting structure.

19 Claims, 10 Drawing Sheets

(56) References Cited

OTHER PUBLICATIONS

All Office Actions, U.S. Appl. No. 16/920,304.
U.S. Unpublished U.S. Appl. No. 16/920,300, filed Jul. 2, 2020, to first inventor Ian Anthony Good.
U.S. Unpublished Patent Application U.S. Appl. No. 16/920,304, filed Jul. 2, 2020, to first inventor Alexander Hiller.
15829—PCT Search Report and Written Opinion for PCT/US2021/038342 dated Nov. 12, 2021, 13 pages.

* cited by examiner

GROOMING DEVICE HAVING AN EJECT SENSOR

FIELD OF THE INVENTION

The present invention relates to a grooming device and more particularly to a grooming device having the ability to improve the usage experience of the grooming device by providing information about the usage experience to the user related to the grooming device.

BACKGROUND OF THE INVENTION

There are numerous grooming devices used by consumers every day. Proper usage techniques of such grooming devices and product consumption information facilitate the overall efficacy of the product providing the user with a more positive experience than he or she would have otherwise experienced. Such positive usage experiences will likely lead to continued product usage. Providing the user with information about proper usage techniques for using grooming devices and information about usage and consumption has been limited.

Razors with sensors have been used to provide shave event information to the user. For example, razors with proximity sensors or cameras have been used to provide information on blade attrition and razors with force sensors have been used to provide the user with information on the amount of force being applied to the skin. By tracking the force being applied during the shave provides a metric to gauge blade dulling and predict blade attrition. Razors having sensors to count shaving strokes have also been used to again assist with blade attrition. Cameras have been used to provide users with boundary indicators such as distinguishing between areas of long hair such as sideburns adjacent to areas of shorter hair length.

Razor cartridge consumption is a main driver of value and accurate cartridge consumption data is of interest to grooming device manufacturers and consumers alike. In order to be able to accurately track cartridge usage, two data streams are required; shave event data and cartridge change data. If both of these data streams are available, it is possible both to track consumer usage behavior and provide consumer relevant features such as cartridge life indication. While grooming devices, such as razors, with sensors to provide shave event data have been provided, a grooming device that can provide cartridge change data is needed.

In addition, some currently grooming devices have a secondary pivot axis built into the handle or neck area that allows the grooming implement and/or the connection structure to rotate side to side, as well as up and down, in use. However, in these grooming devices, the cartridge eject button is directly attached to the connection structure and any rotation around the secondary pivot axis also causes the eject button to rotate relative to the handle, which introduces noise into the data collected regarding cartridge change data. Therefore, a grooming device is needed that can have multiple axes of rotation for the grooming implement/connection structure and still accurately provide cartridge change data.

SUMMARY OF THE INVENTION

The present invention relates to a grooming device. The grooming device comprises a handle, and implement connecting structure, and a grooming element. The handle comprises a proximal end, a distal end, a displacement sensor, and a power source providing power to the displacement sensor. The implement connecting structure is pivotably connected to the proximal end of the handle about a first handle axis and comprises a connection element and an eject element. The eject element is moveable within the implement connecting structure along a second handle axis. The implement connecting structure also comprises a location element that is pivotably connected to the eject element such that as the implement connecting structure moves about the first handle axis the location element remains stationary relative to the handle and as the eject element moves along the second handle axis the location element is displaced relative to the handle and the displacement sensor detects displacement of the location element. The grooming implement is connected to the implement connecting structure.

The handle can have a housing portion and a neck portion pivotably connected to the housing portion about a third handle axis. The displacement sensor and the power source may be disposed in the housing portion or the neck portion and the implement connecting structure is pivotably connected to a proximal end of the neck portion about the first handle axis.

The neck portion and implement connecting structure may be able to move about a third handle axis.

The displacement sensor may comprise a magnetic sensor, an optical sensor, a capacitive sensor, an inductive sensor, a resistive sensor, a conductive sensor, a proximity sensor, an electrical switch, a mechanical switch, an electromechanical switch, or an electromagnetic switch.

The location element can comprise a magnet, visual marker, a physical marker, or an electrically conductive material.

The location element can include a locator disposed therein, the locator is preferably located in the distal end of the location element. The locator can comprise a magnet, visual marker, a physical marker, or an electrically conductive material.

The handle can contain a communication means.

Data from the displacement sensor can be communicated to the user or another device.

The handle can include a shave event sensor. The handle can process cumulative shave data from the shave event sensor. Data from the displacement sensor is used to reset the cumulative shave data.

The grooming device can include a base which can serve as a charging station for the power source. The base may also include a communication device, a processor, and memory, which can store and process data received from the grooming device.

The grooming device can be an electric shaver, a shaving razor and/or an epilator.

BRIEF DESCRIPTION OF THE DRAWINGS

While the specification concludes with claims particularly pointing out and distinctly claiming the subject matter that is regarded as forming the present invention, it is believed that the invention will be better understood from the following description, which is taken in conjunction with the accompanying drawings in which like designations are used to designate substantially identical elements, and in which:

DETAILED DESCRIPTION OF THE INVENTION

Figure 1:
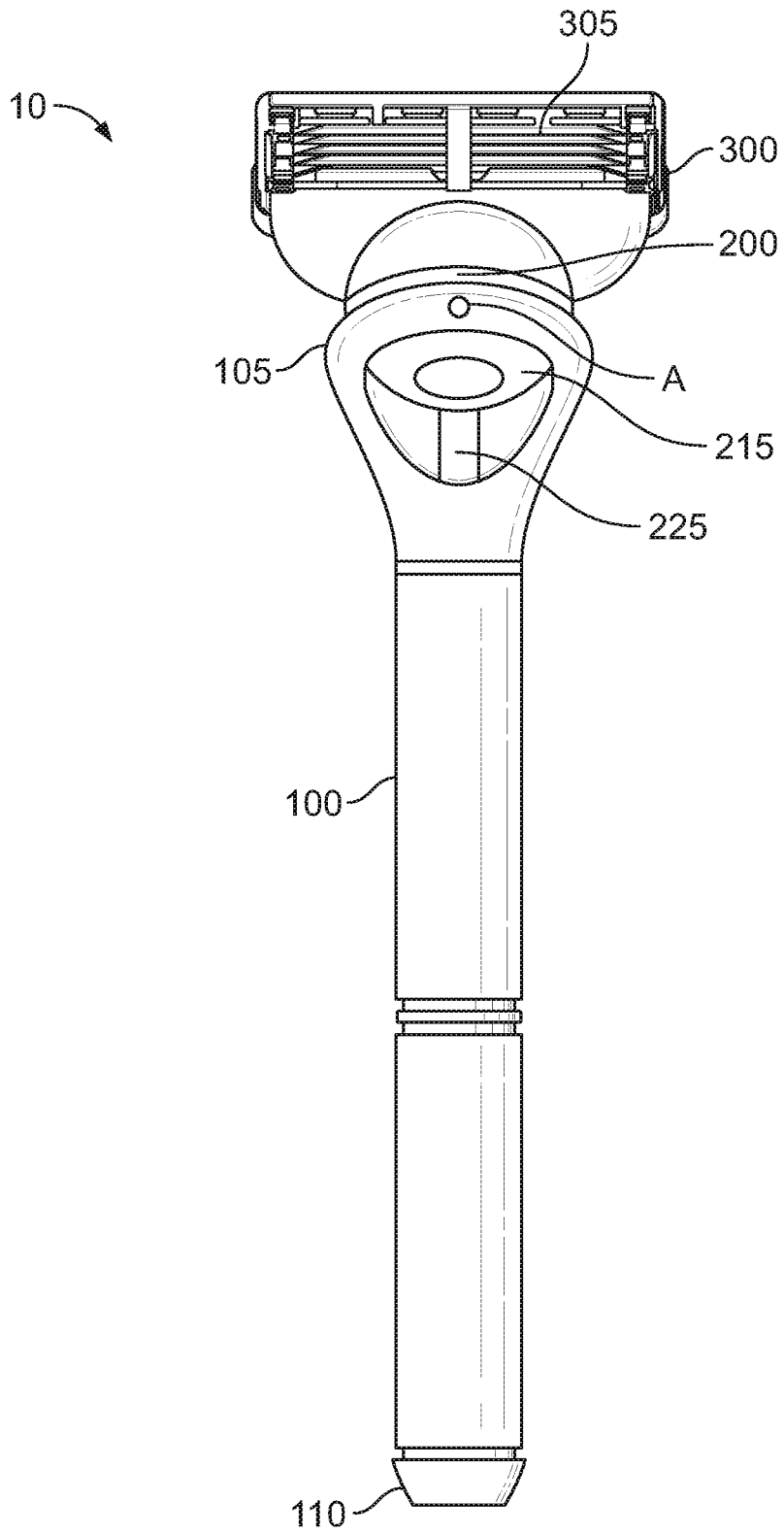
FIG. 1 is a front plan view of a grooming device of the present invention.

Referring to FIG. 1, a grooming device 10 is shown. As shown, grooming device 10 is a shaving razor, but could also be an electric shaver, an epilator, and/or any other type of grooming device. Grooming device 10 generally includes a handle 100 having a proximal end 105 and a distal end 110, an implement connecting structure 200 pivotably connected to proximal end 105 of handle 100, and a grooming implement 300 removably connected to implement connecting structure 200. The grooming implement 300 shown is a razor cartridge that includes one or more blades 305 for cutting hair.

Referring to FIGS. 2-6, a displacement sensor 115, which is preferably a contactless sensor and could be a magnetic sensor, an optical sensor, a capacitive sensor, an inductive sensor, a resistive sensor, a conductive sensor, a proximity sensor, an electrical switch, a mechanical switch, an electromechanical switch, or an electromagnetic switch, etc., is positioned within handle 100 and is configured to sense the position of a location element 225 of implement connecting structure 200, which could be a magnet, a visual marker, a physical marker, an electronically conductive material, etc. A power source 120, such as a battery, is also positioned within handle 100 and is operatively connected to displacement sensor 115 to provide power to displacement sensor 115 and to any other sensors and devices within handle 100 that require power.

Implement connecting structure 200 is pivotably connected to proximal end 105 of handle 100 via posts 205 on implement connecting structure 200 that extend into opposing holes 137 in handle 100 such that implement connecting structure can pivot about a first handle axis A relative to handle 100. As shown, implement connecting structure 200 includes a connection element 210 configured to secure grooming implement 300 to implement connecting structure 200 and an eject element 215, such as a push button, configured to eject grooming implement 300 from implement connecting structure 200. Eject element 215 is moveable, preferably slidable, within implement connecting structure 200 along a second handle axis B and is biased into a first position by spring 220.

Implement connecting structure 200 also contains location element 225. Proximal end 240 of location element 225 has a coupling element 245 that receives a protrusion 222 of eject element 215 to pivotably connect location element 225 to eject element 215, preferably allowing implementing connecting structure 200 to rotate about handle axis A while location element 225 remains stationary relative to handle 100, but coupling location element 225 and eject element 215 together when eject element 215 is moved or slid along handle axis B such that location element 225 is displaced relative to handle 100 when eject element 215 moves along second handle axis B. Additionally, distal end 235 of location element 225 is constrained from rotating about handle axis A and is slidably connected to handle 100 by guiding elements 145 of handle 100, but is not constrained from moving along handle axis B.

Figure 2:
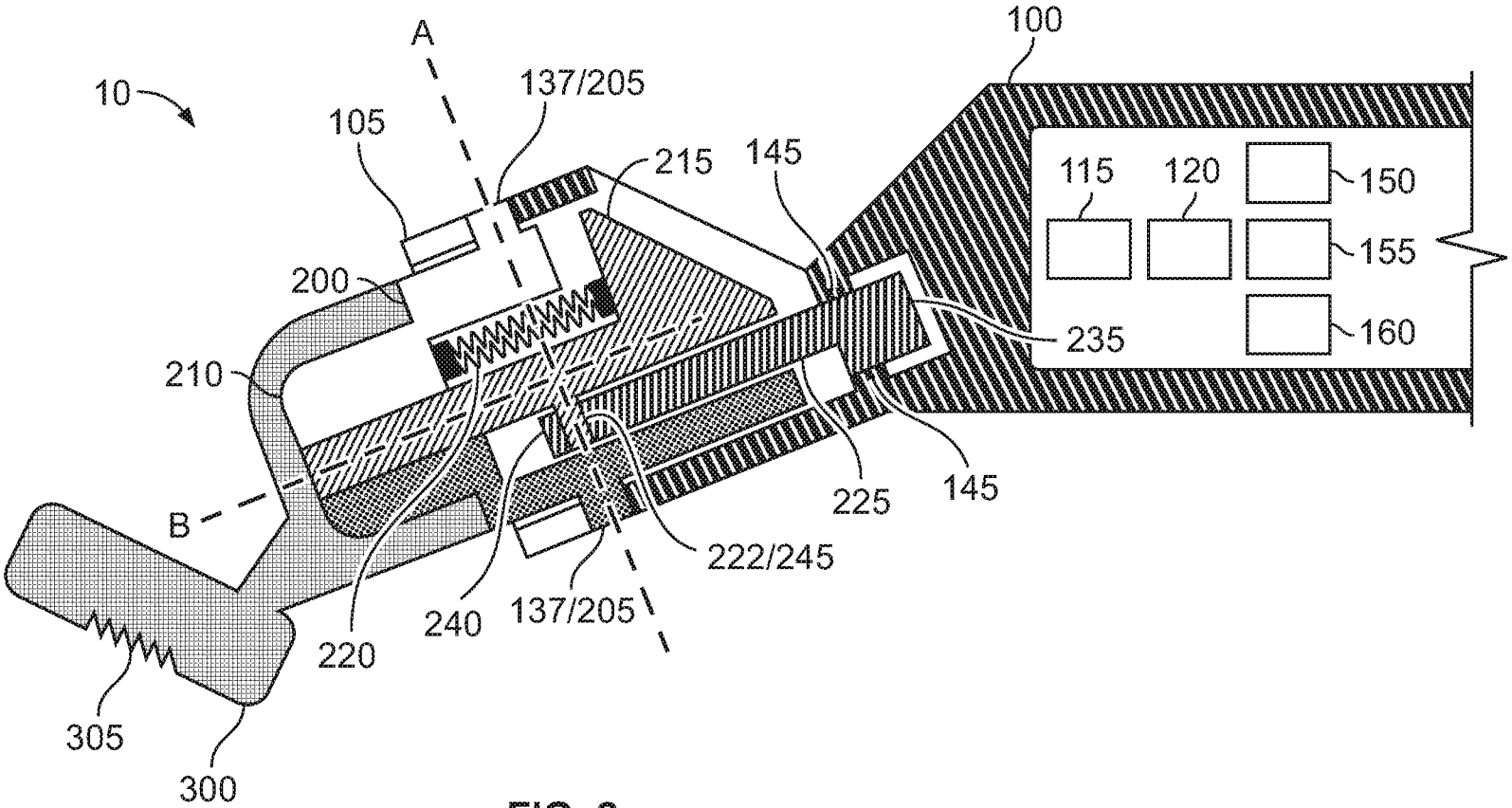
FIG. 2 is a partial cut away side view of the grooming device of FIG. 1 with the eject element in a first position.
Figure 3:
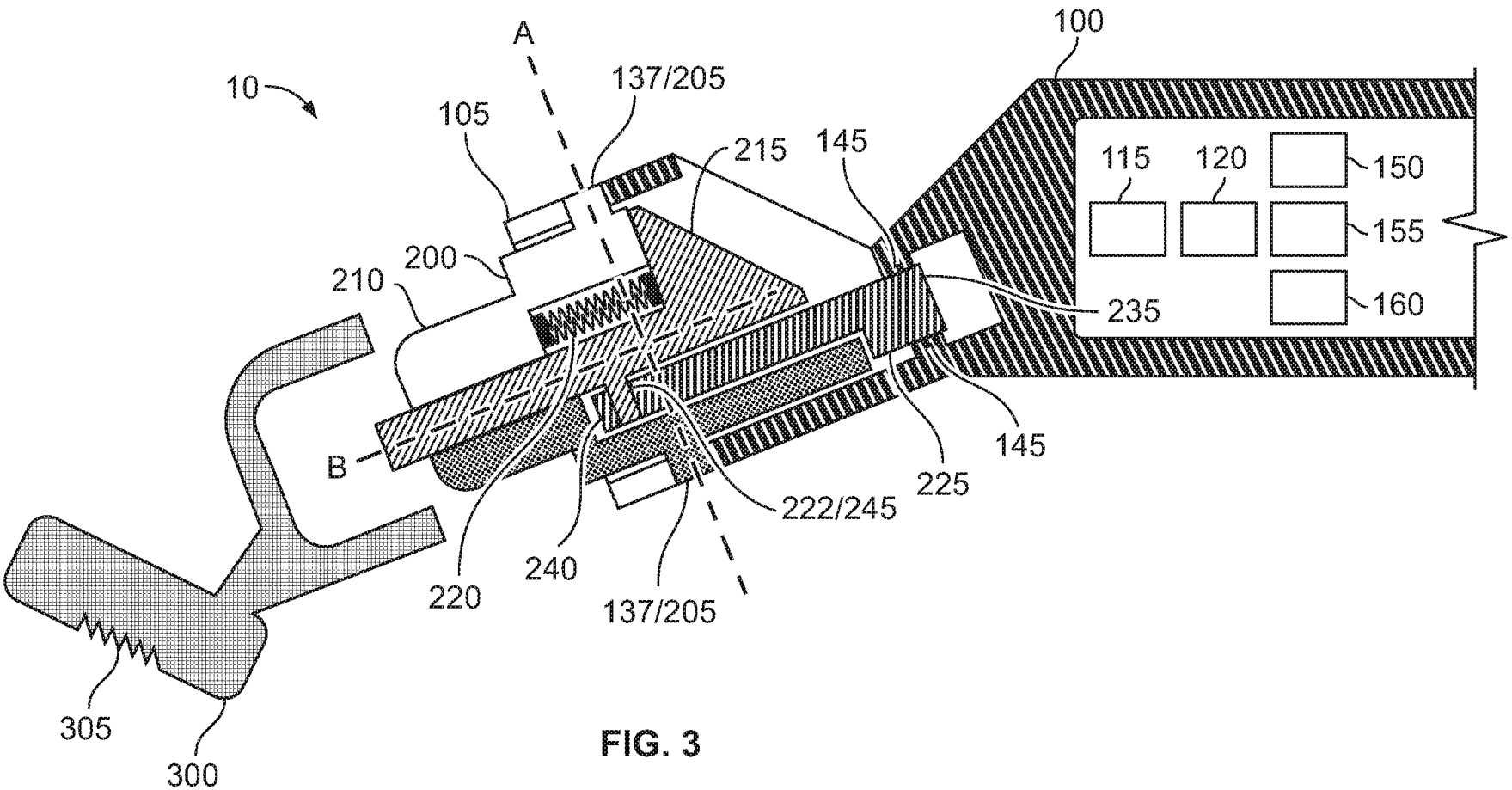
FIG. 3 is a partial cut away side view of the grooming device of FIG. 1 with the eject element in a second position and the grooming implement detached.
Figure 4:
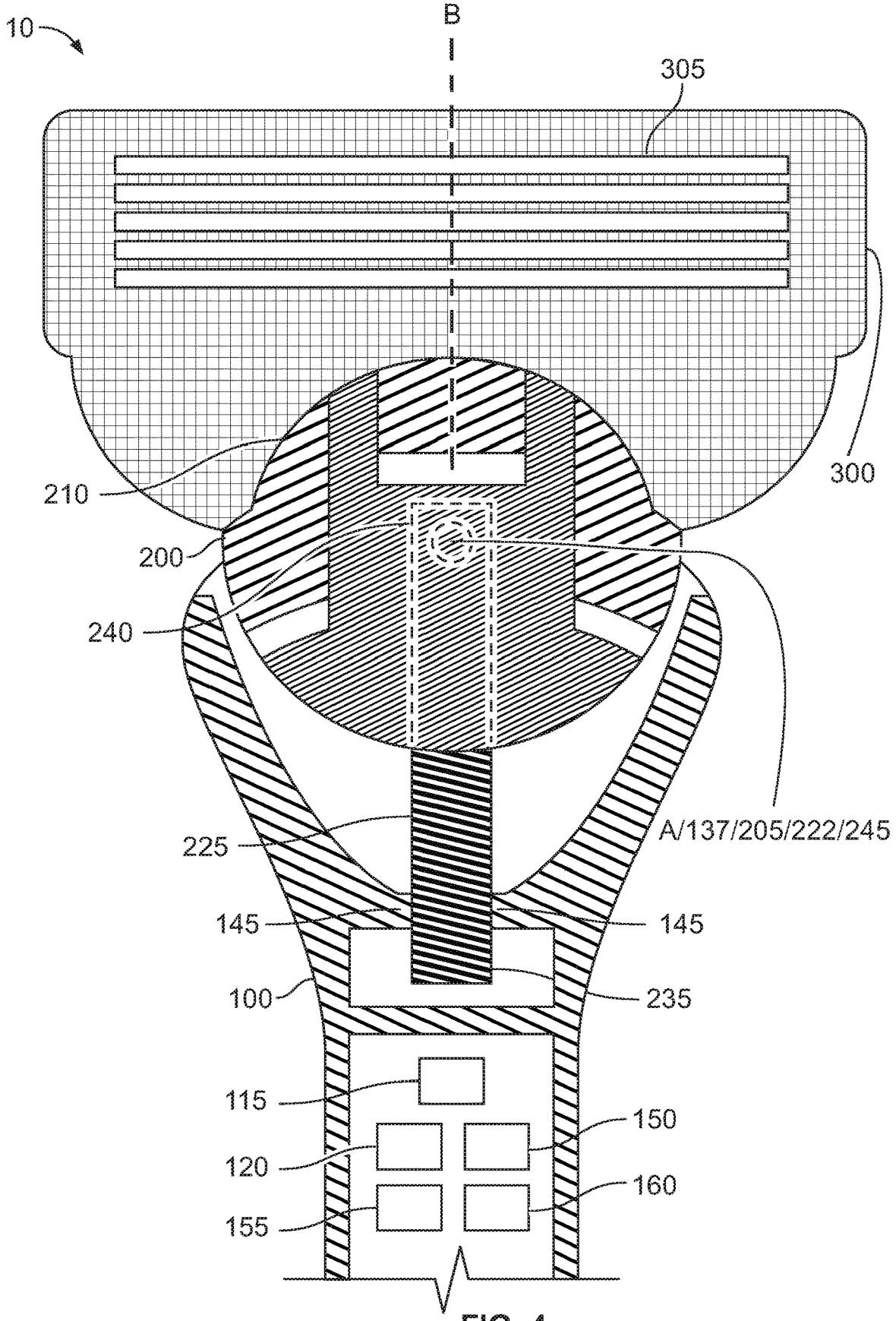
FIG. 4 is a partial cut away front view of the grooming device of FIG. 1 with the implement connecting structure in a first position and the eject element in a first position.
Figure 5:
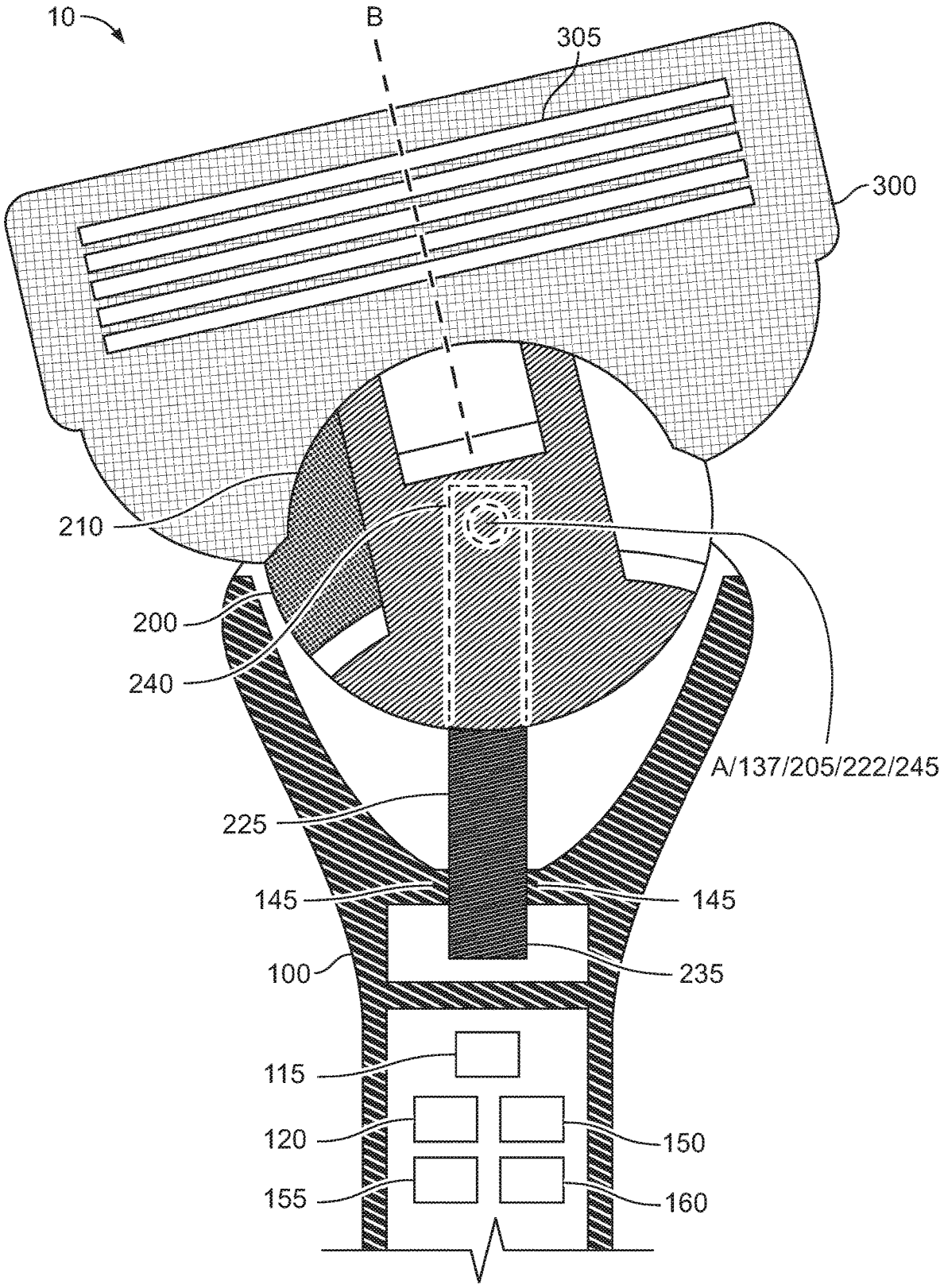
FIG. 5 is a partial cut away front view of the grooming device of FIG. 1 with the implement connecting structure in a second position and the eject element in a first position.
Figure 6:
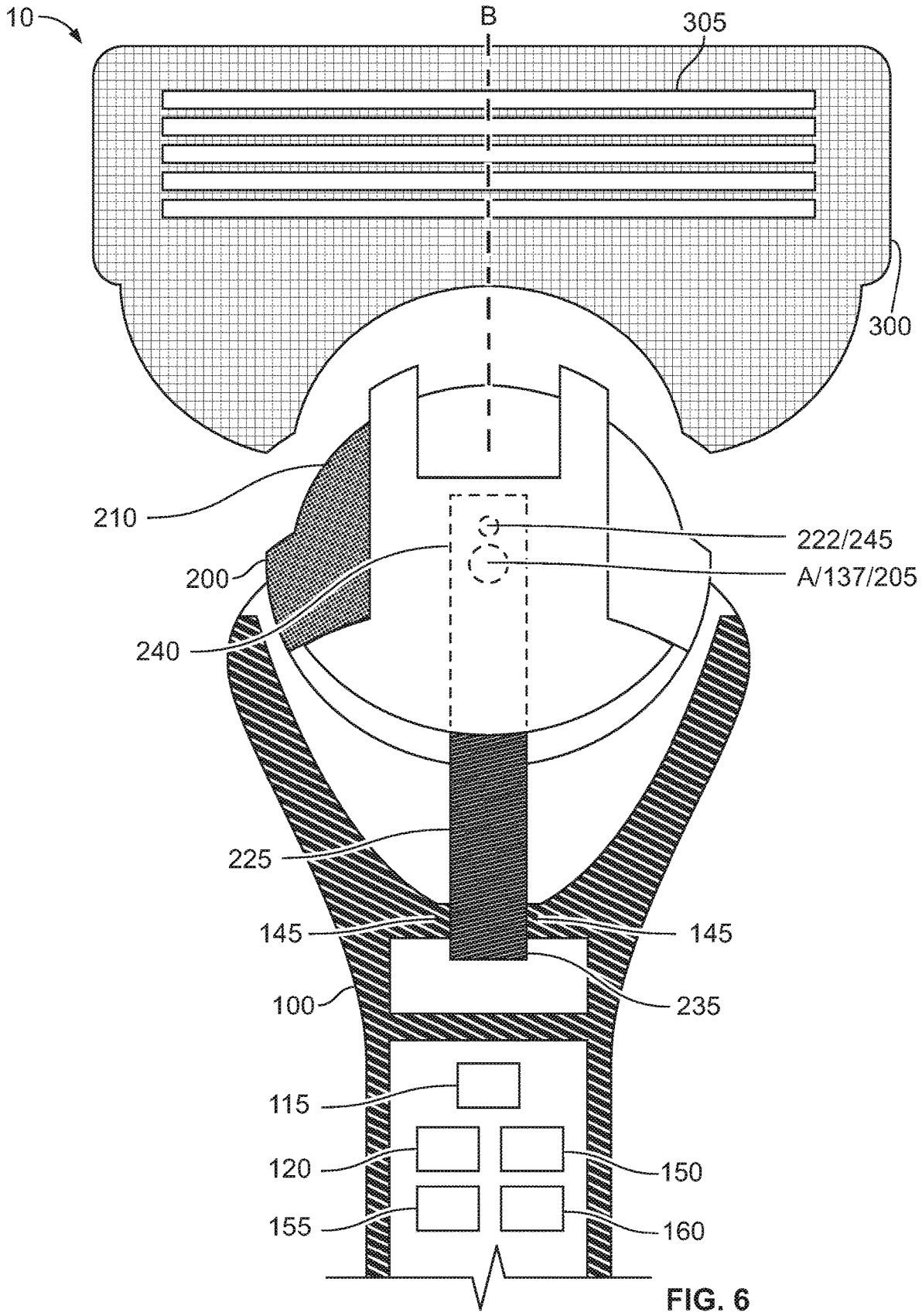
FIG. 6 is a partial cut away front view of the grooming device of FIG. 1 with the implement connecting structure in a first position, the eject element in a second position, and the grooming implement detached.

In use, grooming implement 300 is connected to connection element 210 and eject element 215 remains in the first position or rest position (FIG. 2). In the first position, displacement sensor 115 will detect a constant position of location element 225, even if implement connecting structure 200 and eject element 215 pivot about first handle axis A. When eject element 215 is moved from the first position to the second position to eject grooming implement 300 (FIG. 3), eject element 215 slides forward, which pulls location element 225 forward, and the distance between displacement sensor 115 and location element 225 increases. The increase in the distance between displacement sensor 115 and location element 225 results in a reduction of the signal strength from location element 225 to displacement sensor 115. Once grooming implement 300 has been detached and any user force removed from eject element 215, spring 220 biases eject element 215 and location element 225 back to the first position, which again increases the signal strength from location element 225 to displacement sensor 115. The data from displacement sensor 115 can then be analyzed to identify an eject event, which is characterized by a momentary negative peak or reduction in the signal strength as locator 260 is moved away from displacement sensor 115 and back.

Alternatively, rather than separate elements as described above, eject element 215 and location element 225 can be manufactured as a single, unitary component with a flexible live hinge feature replacing the coupling elements between eject element 215 and location element 225. This may simplify the assembly of eject element 215 and location element 225 while still offering a desired degree of freedom.

An alternative approach to the mechanical concept described above would be to collect data that includes secondary pivot noise and then attempt to remove the noise retrospectively using software filters and algorithms. However, while a software method such as this would result in a simpler mechanical device, it is more efficient to eliminate the noise mechanically at the source to improve the quality of the data collected, rather than have to clean it up later. The mechanical concept described above also reduces the immediate processing requirements if the data stream is to be used for live features during use, such as load feedback.

Handle 100 can also include a shave event sensor 150, preferably in housing portion 125, such as those discussed in U.S. patent application Ser. No. 16/251,535, the entirety of which is incorporated by reference herein. Handle 100 can process cumulative shave data from shave event sensor 150, for example using processor 160, and data from displacement sensor 115 regarding the ejection of grooming implement 300 can be used to reset the cumulative shave data.

Handle 100 can also include a communication means 155, such as a visual indicator, a light emitting diode (LED), a vibration mechanism, an audio mechanism, a wired connection, a Bluetooth connection, a Wi-Fi connection, an infrared connection, a cellular connection, etc., which can be used to communicate data from displacement sensor 115 to a user of grooming device 10 and/or to another device, such as another grooming device 10, base 400, a mobile phone, a computer application, a computer, an electronic device, etc.

Handle 100 can also include a processor 160. Processor 160 can use an algorithm to calculate an eject event of grooming implement 300 based on the displacement of location element 225 detected by displacement sensor 115.

Figure 7:
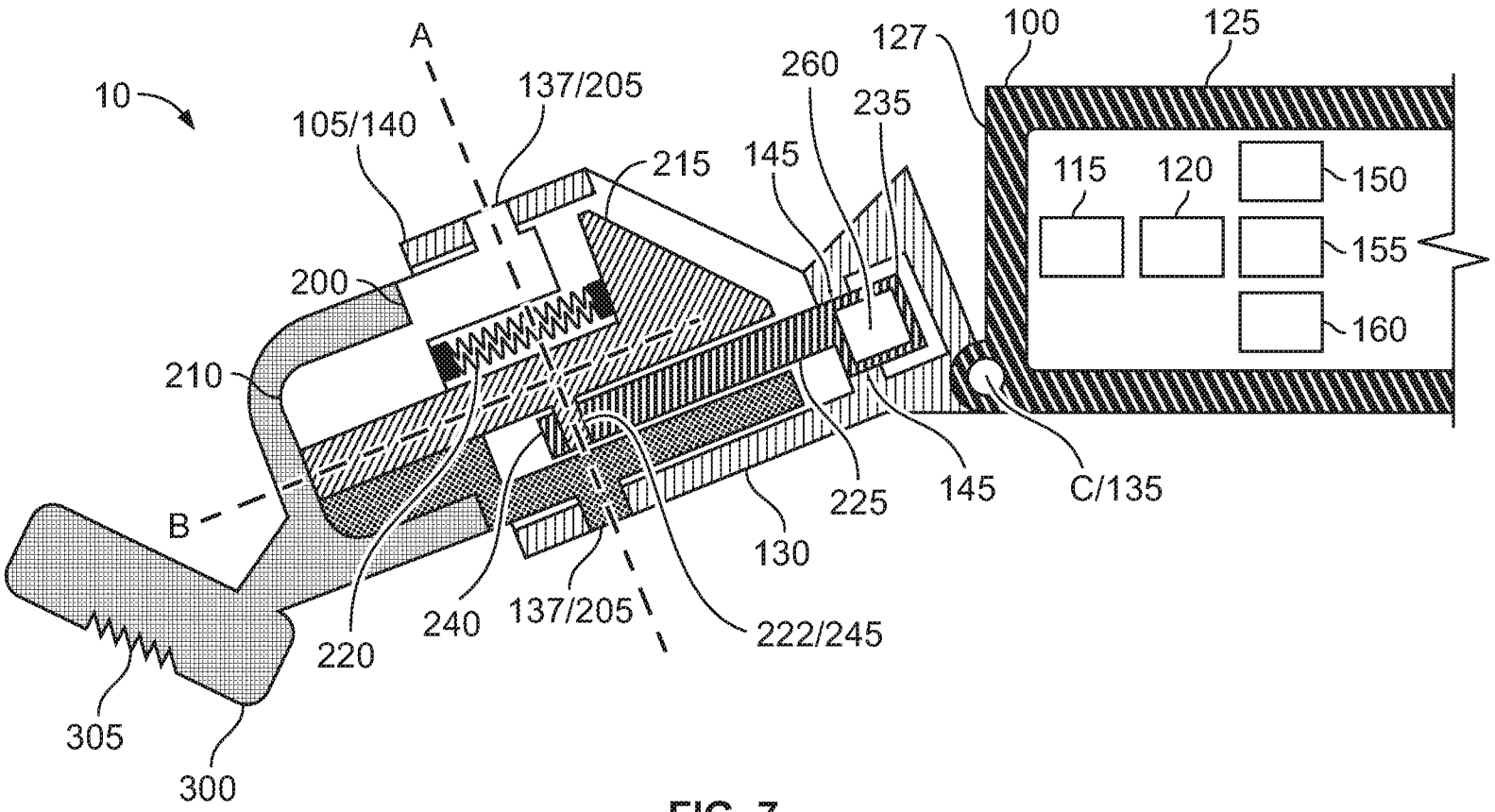
FIG. 7 is a partial cut away side view of the grooming device of FIG. 1, with an alternative handle having a housing portion and a neck portion.
Figure 8:
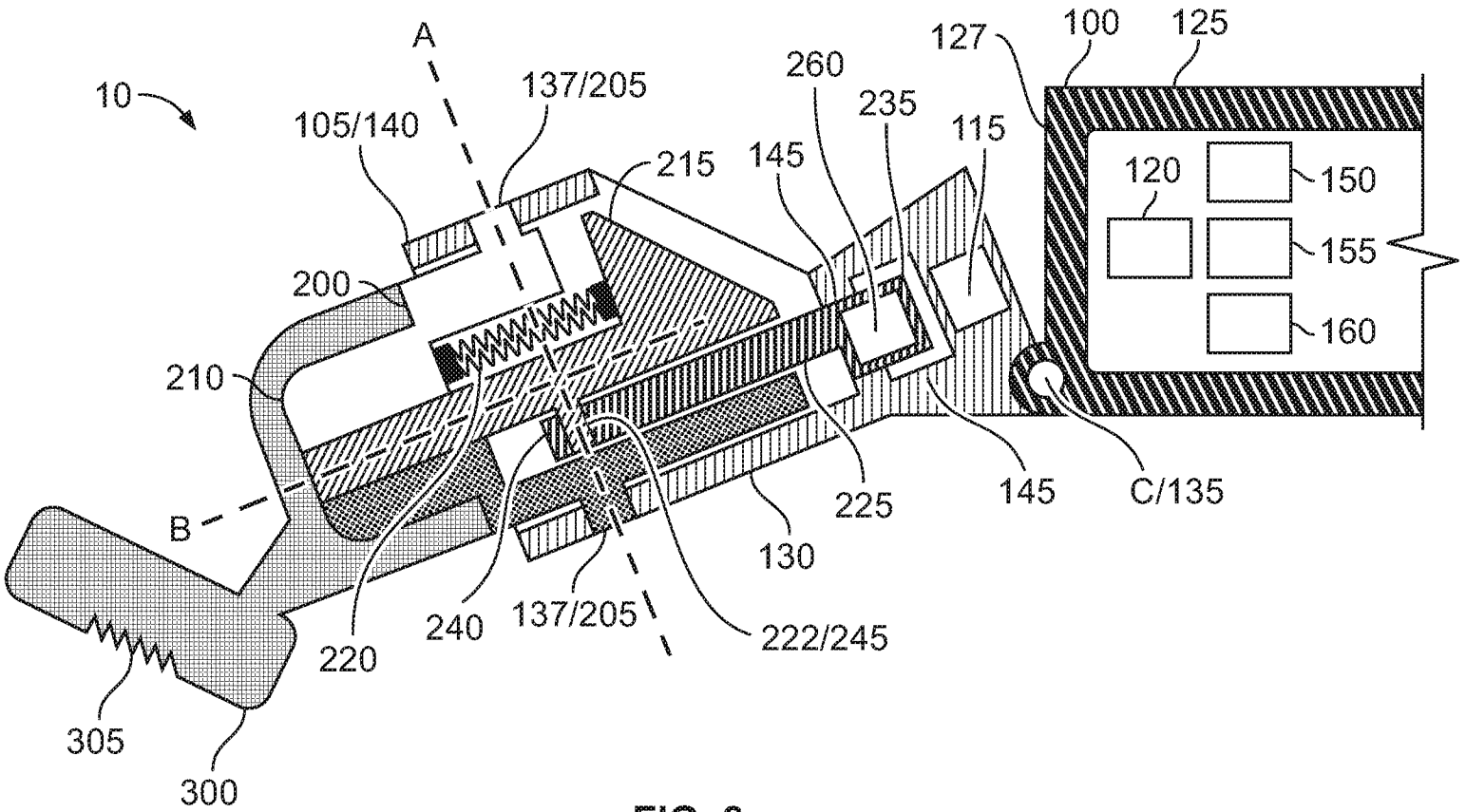
FIG. 8 is a partial cut away side view of the grooming device of FIG. 7 with the displacement sensor in an alternative position.

As shown in FIGS. 7-8, handle 100 can also include a housing portion 125, that is preferably water tight, and a neck portion 130 that is pivotably connected to housing portion 125 via pin 135 in neck portion 130 that extends through opposing openings in housing portion 125 such that neck portion 130 can rotate about a third handle axis C relative to housing portion 125. Implement connecting structure 200 would also be able to move or rotate about third handle axis C. Displacement sensor 115 can be disposed in housing portion 125 or neck portion 130 of handle 100 and power source 120 can be disposed in housing portion 125 of handle 100. Preferably, displacement sensor 115 is positioned at a proximal end 127 of housing portion 125, immediately adjacent neck portion 130. As shown, implement connecting structure 200 is pivotably connected to proximal end 140 of neck portion 130 about first handle axis A.

Handle 100 can also include a processor 160, shave event sensor 150, and/or communication means 155, as described above, preferably in housing portion 125

Location element 225 can also include a locator 260, such as a magnet, a visual marker, a physical marker, an electronically conductive material, etc., that is preferably embedded or secured within a distal end 235 of location element 225 and can be sensed by displacement sensor 115.

Figure 9:
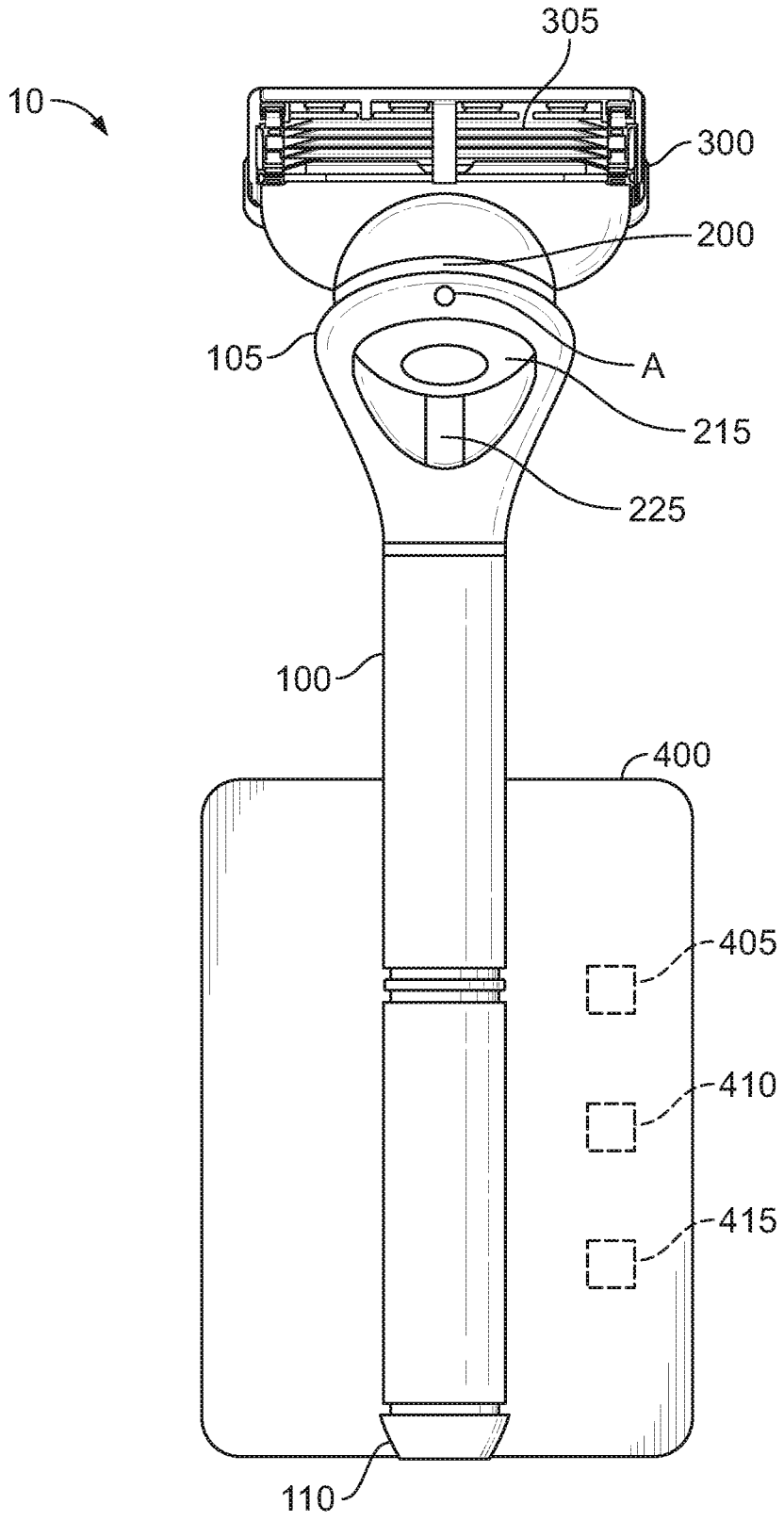
FIG. 9 is a front plan view of the grooming device of FIG. 1 and a base.

As shown in FIG. 9, when not in use, grooming device 10 can be held in base 400, which can serve as a charging station for power source 120. Base 400 may also include a communication device 405, which can communicate with communication means 155 in handle 100 of grooming device 10 and/or can be mounted in base 400 so that it is visible to the user to provide direct communication to the user. Base 400 may also include a processor 410 and memory 415, which can store data received from grooming device 10 to be processed by processor 410.

Figure 10:
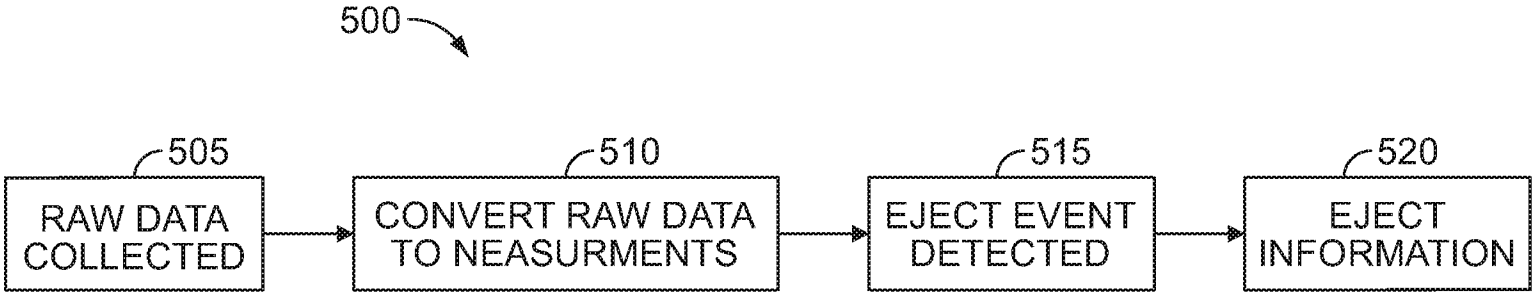
FIG. 10 is a plan diagram of the collected eject event data and associated algorithms.

Referring now to FIG. 10, there is shown a plan diagram 500 of the collected data and algorithms used with grooming device 10. At 505, with the power source 120 on, raw data is collected from displacement sensor 115 and, if used, from shave event sensor 150. The raw data is then converted into measurements at 510. The measurements may be made by processor 160 in handle 100. Alternatively, the raw data can be sent from communication means 155 to an external device such as a mobile phone, a computer application, a computer, or other electronic device to convert the raw data in measurements.

At 515 an eject event including the ejection of grooming implement 300 from handle 100 is detected from the raw data of displacement sensor 115 using an algorithm. The algorithm may comprise monitoring the displacement of location element 225 by displacement sensor 115 to detect movement of eject element 215 and calculating an eject event of grooming implement 300 based on displacement of location element 225. The algorithm may comprise monitoring the activity strength as recorded by displacement sensor 115.

At 520 grooming implement eject information can be generated from the measurements based on the data from displacement sensor 115. In addition, if shave event sensor 150 is used and handle 100 processes cumulative shave data, data from displacement sensor 115 can be used to reset the cumulative shave data based on the grooming implement eject information and/or to trigger a notification to the user asking them to confirm or cancel the reset of the cumulative shave data based on the grooming implement eject information.

An Example is Below:

A. A grooming device comprising:
  a. a handle comprising a proximal end and a distal end, the handle comprising;
    i. a displacement sensor; and
    ii. a power source, the power source providing power to the displacement sensor;
  b. an implement connecting structure comprising a connection element and an eject element, the implement connecting structure being pivotably connected to the proximal end of the handle about a first handle axis, and the eject element being slidable within the implement connecting structure along a second handle axis, the implement connecting structure further comprising;
    i. a location element, the location element being pivotably connected to the eject element such that as the implement connecting structure moves about the first handle axis the location element remains stationary relative to the handle and as the eject element moves along the second handle axis the location element is displaced relative to the handle and the displacement sensor detects displacement of the location element; and
  c. a grooming implement connected to the implement connecting structure.

B. The grooming device of paragraph A, wherein the handle comprises a housing portion and a neck portion pivotably connected to the housing portion about a third handle axis and the implement connecting structure is pivotably connected to a proximal end of the neck portion about the first handle axis.

C. The grooming device of paragraph B, wherein the displacement sensor is positioned within the housing portion.

D. The grooming device of paragraph B, wherein the displacement sensor is positioned within the neck portion.

E. The grooming device of paragraph B, wherein the power source is positioned within the housing portion of the handle.

F. The grooming device of any one of paragraphs A-E, wherein the implement connecting structure is able to move about a third handle axis.

G. The grooming device of any one of paragraphs A-F, wherein the displacement sensor comprises a magnetic sensor, an optical sensor, a capacitive sensor, an inductive sensor, a resistive sensor, a conductive sensor, a proximity sensor, an electrical switch, a mechanical switch, an electromechanical switch, or an electromagnetic switch.

H. The grooming device of any one of paragraphs A-G, wherein the location element comprises a magnet, visual marker, a physical marker or an electrically conductive material.

I. The grooming device of paragraph H, wherein the location element comprises a locator.

J. The grooming device of paragraph I, wherein the locator comprises a magnet, visual marker or an electrically conductive material.

K. The grooming device of any one of paragraphs A-J, wherein the handle comprises one or more guiding elements to slidably connect the location element to the handle.

L. The grooming device of any one of paragraphs A-K, wherein the location element comprises one or more coupling elements to pivotably connect the location element to the eject element.

M. The grooming device of any one of paragraphs A-L, wherein the handle contains a communication device.

O. The grooming device of paragraph M, wherein the communication device comprises a visual indicator, an LED, a vibration mechanism, an audio mechanism, a wired connection, a Bluetooth connection, a Wi-Fi connection, a cellular connection, or an infrared connection.

P. The grooming device of paragraph M, wherein data from the displacement sensor is communicated to the user or another device.

Q. The grooming device of any one of paragraphs A-P, wherein the handle further comprises a shave event sensor.

R. The grooming device of paragraph Q, wherein the handle processes cumulative shave data from the shave event sensor.

S. The grooming device of paragraph R, wherein data from the displacement sensor is used to reset the cumulative shave data.

T. The grooming device of any one of paragraphs A-S, wherein an algorithm calculates an eject event of the grooming implement based on displacement of the location element.

U. The grooming device of any one of paragraphs A-T, wherein the grooming device comprises an electric shaver, a shaving razor and/or an epilator.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A grooming device comprising:

a. a handle comprising a proximal end and a distal end, the handle comprising;
   i. a displacement sensor; and
   ii. a power source, the power source providing power to the displacement sensor;

b. an implement connecting structure comprising a connection element and an eject element, the implement connecting structure being pivotably connected to the proximal end of the handle about a first handle axis, and the eject element being moveable within the implement connecting structure along a second handle axis, the implement connecting structure further comprising;
   i. a location element, the location element being pivotably connected to the eject element such that as the implement connecting structure moves about the first handle axis the location element remains stationary relative to the handle and as the eject element moves along the second handle axis the location element is displaced relative to the handle and the displacement sensor detects displacement of the location element; and c. a grooming implement connected to the implement connecting structure.

2. The grooming device of claim 1, wherein the handle comprises a housing portion and a neck portion pivotably connected to the housing portion about a third handle axis and the implement connecting structure is pivotably connected to a proximal end of the neck portion about the first handle axis.

3. The grooming device of claim 2, wherein the displacement sensor is positioned within the housing portion.

4. The grooming device of claim 2, wherein the displacement sensor is positioned within the neck portion.

5. The grooming device of claim 2, wherein the power source is positioned within the housing portion of the handle.

6. The grooming device of claim 2, wherein the implement connecting structure is able to move about a third handle axis.

7. The grooming device of claim 1, wherein the displacement sensor comprises a magnetic sensor, an optical sensor, a capacitive sensor, an inductive sensor, a resistive sensor, a conductive sensor, a proximity sensor, an electrical switch, a mechanical switch, an electromechanical switch, or an electromagnetic switch.

8. The grooming device of claim 1, wherein the location element comprises a magnet, visual marker, a physical marker, or an electrically conductive material.

9. The grooming device of claim 1, wherein the location element comprises a locator.

10. The grooming device of claim 9, wherein the locator comprises a magnet, visual marker or an electrically conductive material.

11. The grooming device of claim 1, wherein the handle comprises one or more guiding elements to slidably connect the location element to the handle.

12. The grooming device of claim 1, wherein the location element comprises one or more coupling elements to pivotably connect the location element to the eject element.

13. The grooming device of claim 1, wherein the handle contains a communication device.

14. The grooming device of claim 13, wherein the communication device comprises a visual indicator, an LED, a vibration mechanism, an audio mechanism, a wired connection, a Bluetooth connection, a Wi-Fi connection, a cellular connection, or an infrared connection.

15. The grooming device of claim 13, wherein data from the displacement sensor is communicated to a user or another device.

16. The grooming device of claim 1, wherein the handle further comprises a shave event sensor.

17. The grooming device of claim 16, wherein the handle further comprises a processor that processes cumulative shave data from the shave event sensor.

18. The grooming device of claim 17, wherein the processor uses data from the displacement sensor to reset the cumulative shave data.

19. The grooming device of claim 1, wherein the grooming device comprises an electric shaver, a shaving razor and/or an epilator.

* * * * *